US009115517B2

(12) United States Patent
Clay et al.

(10) Patent No.: US 9,115,517 B2
(45) Date of Patent: Aug. 25, 2015

(54) FOLDABLE DOOR STOP

(71) Applicant: CQ Innovations, Cotati, CA (US)

(72) Inventors: James Clay, Cotati, CA (US); Jesse Quiles, South San Francisco, CA (US)

(73) Assignee: CQ Innovations, LLC, Cotati, CA (US)

( * ) Notice: Subject to any disclaimer, the term of this patent is extended or adjusted under 35 U.S.C. 154(b) by 0 days.

(21) Appl. No.: 14/253,617

(22) Filed: Apr. 15, 2014

(65) Prior Publication Data

US 2014/0304943 A1 Oct. 16, 2014

Related U.S. Application Data

(60) Provisional application No. 61/812,042, filed on Apr. 15, 2013.

(51) Int. Cl.
*E05C 17/54* (2006.01)

(52) U.S. Cl.
CPC ..... *E05C 17/54* (2013.01); *Y10T 16/61* (2015.01); *Y10T 292/71* (2015.04); *Y10T 292/73* (2015.04)

(58) Field of Classification Search
CPC ..... E05C 17/54; Y10T 16/61; Y10T 292/71; Y10T 292/73
See application file for complete search history.

(56) References Cited

U.S. PATENT DOCUMENTS

| | | | | | |
|---|---|---|---|---|---|
| 693,740 | A | * | 2/1902 | Raether | 292/343 |
| 971,717 | A | * | 10/1910 | Bates | 292/343 |
| 1,166,009 | A | * | 12/1915 | Schneider | 292/343 |
| 1,181,056 | A | * | 4/1916 | Arnt | 292/343 |
| 1,545,532 | A | * | 7/1925 | Stubbs | 292/343 |
| 1,555,129 | A | * | 9/1925 | Lipsius | 292/343 |
| 2,647,782 | A | * | 8/1953 | Fisk | 292/288 |
| 4,163,574 | A | * | 8/1979 | Chezem | 292/338 |
| 5,056,836 | A | * | 10/1991 | Wells | 292/288 |
| 5,492,381 | A | * | 2/1996 | Waters | 292/338 |
| 5,601,320 | A | * | 2/1997 | Miller | 292/343 |

* cited by examiner

*Primary Examiner* — Jeffrey O Brien
(74) *Attorney, Agent, or Firm* — Craig M. Stainbrook; Stainbrook & Stainbrook, LLP

(57) ABSTRACT

A hinged two-part doorstop wedge that can be folded into a generally flat or collapsed configuration, and which can be unfolded and deployed in an elevated configuration for placement on the ground near a door so as to stop the motion of the door. The doorstop includes pivotally coupled first and second hinge elements, wherein in the fully collapsed configuration the first hinge element and the second hinge element have generally coplanar upper and lower surfaces, and when in the elevated configuration the top side of the first hinge element is angled upwardly to engage the bottom rail of a door.

8 Claims, 11 Drawing Sheets

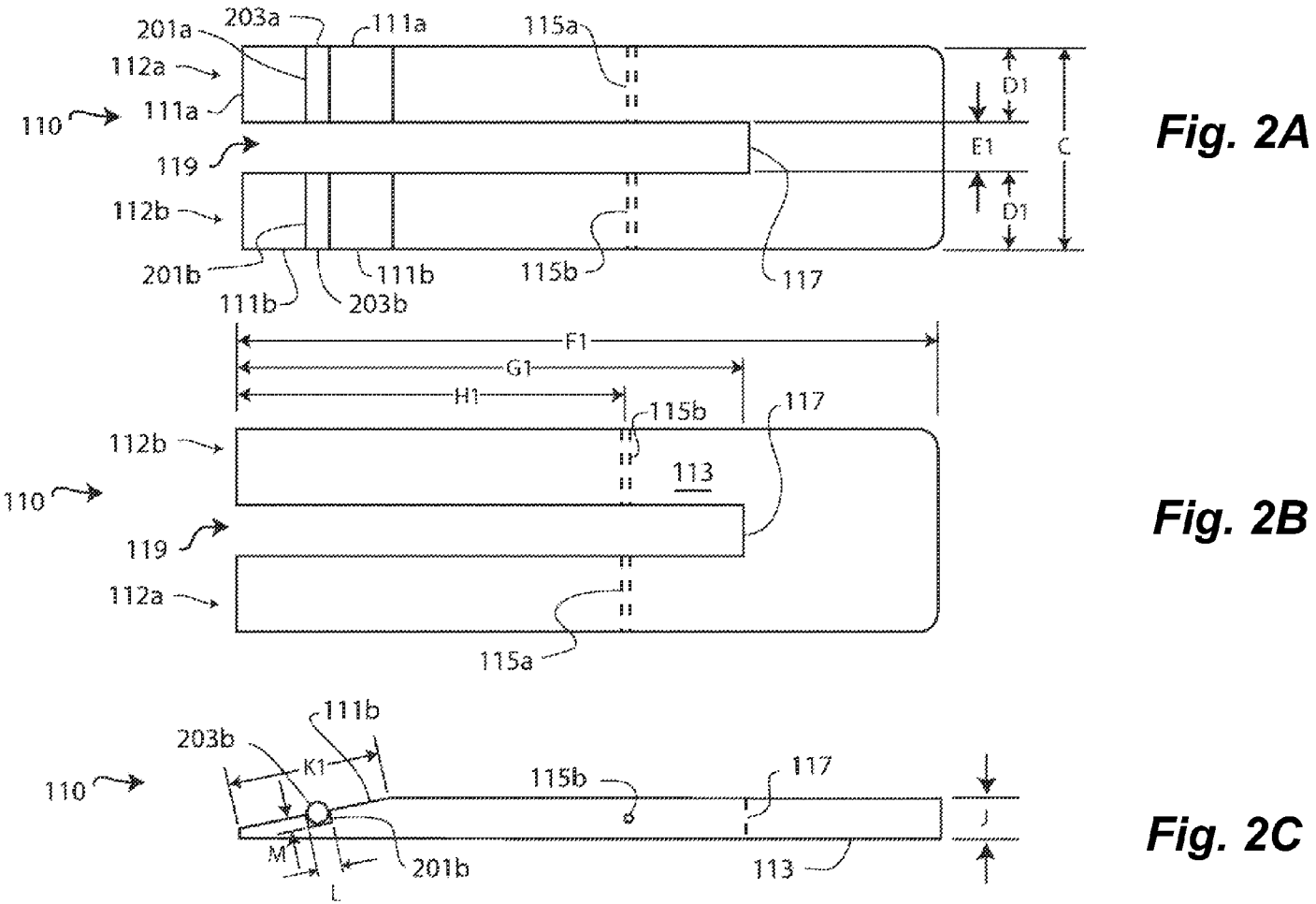
1

FOLDABLE DOOR STOP

CROSS REFERENCES TO RELATED APPLICATIONS

The present application claims the benefit of U.S. Provisional Patent Application Ser. No. 61/812,042, filed Apr. 15, 2013.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

1. Field of the Invention

The present invention generally relates to door stops, and more particularly to a foldable door stop.

2. Background Discussion

Door stops must be tall enough to stop the movement of a door are thus typically an inch thick and wedge shaped. The size and shape of conventional doorstops make them difficult to store and move. There is a need in the art for a doorstop that can effectively stop a door and that can be folded or reconfigured into a more convenient shape for storage and transport.

BRIEF SUMMARY OF THE INVENTION

The present invention overcomes the limitations and problems of the prior art by providing a foldable door stop comprising: a first hinge element and a second hinge element, wherein the first hinge element and the second hinge element are substantially flat and can be placed in a first (collapsed) configuration that is substantially flat and in a second (elevated) configuration having an angled upper surface so as to act as a doorstop.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein:

FIG. 2A is a bottom plan view of a first hinge element of the door stop of FIG. 1A;

FIG. 2B is a top plan view thereof;

FIG. 2C is a side view in elevation thereof;

Figure 1A:
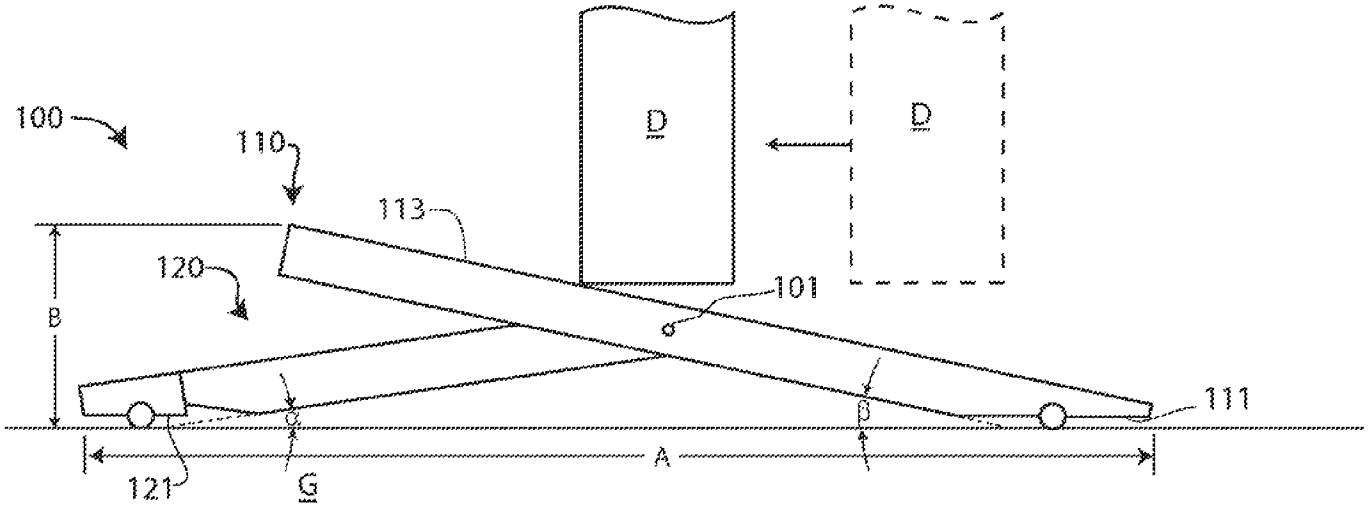
FIG. 1A is a side view in elevation of a first preferred embodiment of the foldable doorstop of the present invention shown in a second (doorstop) configuration.

Reference numbers and symbols are used in the views to indicate certain components, aspects or features shown therein, with reference numbers and symbols common to more than one figure indicating like components, aspects or features in the various views.

DETAILED DESCRIPTION OF THE INVENTION

Referring to FIGS. 1 through 5B, wherein like reference numerals refer to like components in the various views, there is illustrated therein a new and improved foldable doorstop, generally denominated 100 herein.

Figure 1B:
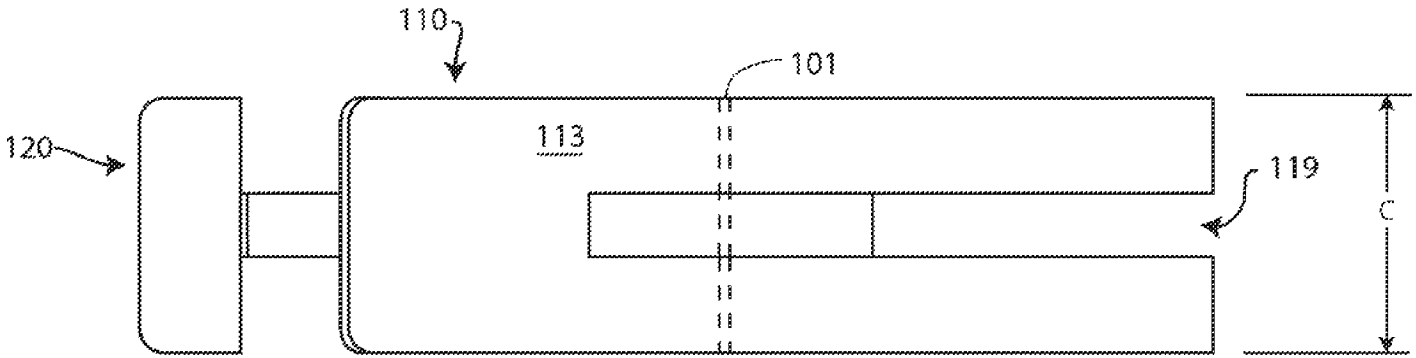
FIG. 1B is a top plan view of the first preferred embodiment.

FIGS. 1A and 1B are a side view and top view, respectively, of a first preferred embodiment 100 of the inventive doorstop. When placed on ground G, doorstop 100 has a length A, a width C, and a height B, wherein the height sufficient to obstruct the radial motion of a door D by engaging the underside of its bottom rail, as shown in FIG. 1A. As will be appreciated from these views, the doorstop comprises a hinged wedge.

In that vein, doorstop 100 includes a first hinge element or component 110 with a ground engaging foot 111 and a door catch surface 113, and a second hinge element or component 120 with a ground engaging foot 121. Hinge components 110 and 120 are joined at a hinge pin 101. Hinge component 110 meets ground G at an angle $\beta$ and hinge component 120 meets the ground at an angle $\alpha$. In a preferred embodiment, hinge elements 110 and 120 are fabricated from a high-density polyethylene.

In certain embodiments, A is approximately 4% inches, B is approximately 1 9/16 inches and C is approximately 2 inches. Angles and β may be of the same degree, or they may be different. In a preferred embodiment, α is approximately 14 degrees, and β is approximately 21 degrees.

FIGS. 2A-2C are views of a first hinge element 110, FIG. 2A being a bottom plan view, FIG. 2B is a top plan view, and FIG. 2C is a side view in elevation. Hinge element 110 has a thickness J, and includes a slot 119 that divides the element into two arms, including a first arm 112*a* and a second arm 112*b*. First and second arms 112*a*, 112*b* each has a hole or slot, preferably a through hole 115*a*, 115*b*, for insertion of a hinge pin, and a portion of ground-engaging foot 111, shown as foot elements 111*a* and 111*b*, respectively. Each foot element 111*a*, 111*b*, includes a groove 201*a*, 201*b*. Each groove 201*a*, 201*b* has a width L, a depth M, and a length D1. A rubber component 203*a*, 203*b* is placed within each groove 201*a*, 201*b*, respectively.

In one embodiment, J is approximately 5/8 inches, F1 is approximately 4 inches, H1 is approximately 2 1/4 inches, G1 is approximate 2 7/8 inches, E1 is approximately 5/8 inches, D1 is approximately 11/16 inches, K1 is approximately 1 1/8 inches, M is approximately 1/8 inches, and N is approximately 3/32 inches. Rubber component 203*a*, 203*b* may be a length of material cut from a 1/8 inch diameter rubber O-ring and is used for cushioning, for non-skid engagement with a floor, and to provide a measure of resilience when the doorstop is urged downwardly by the underside of the bottom rail of a door.

Figure 3A:
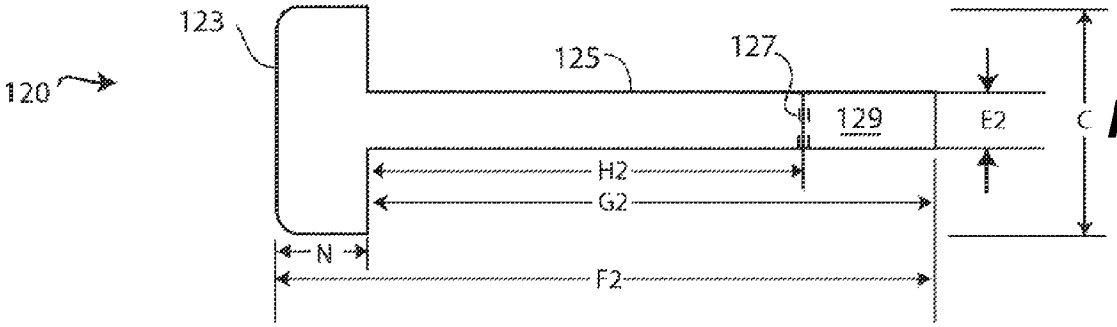
FIG. 3A is a top plan view of a second hinge element of the door stop of FIG. 1A.
Figure 3B:
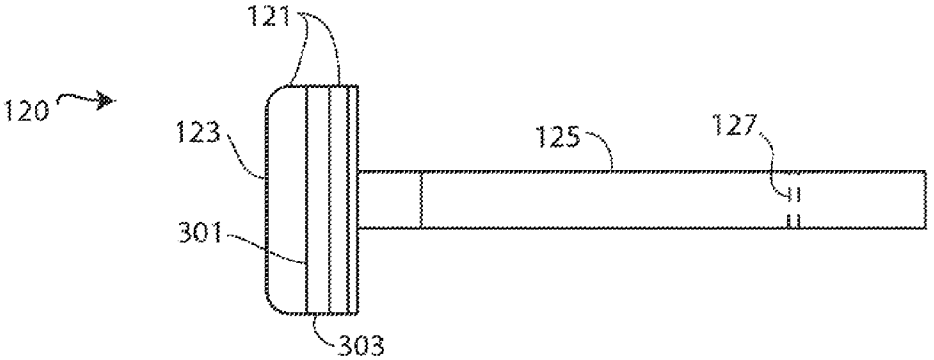
FIG. 3B is a bottom plan view thereof.
Figure 3C:
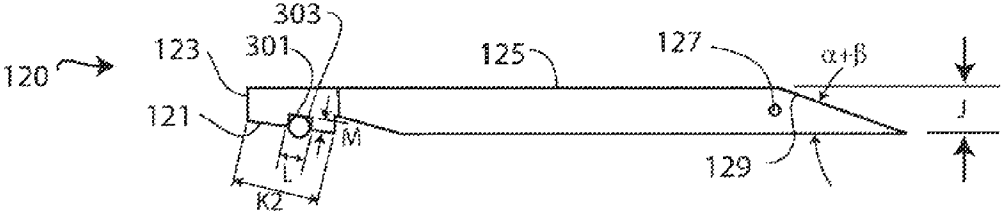
FIG. 3C is a side view in elevation thereof.

FIGS. 3A-3C are views of a second hinge element 120, where FIG. 3A is a top plan view, FIG. 3B is a bottom plan view, and FIG. 3C is a side view in elevation. Second hinge element 120 has an enlarged end 123 and a single arm 125 with a width E2 that is slightly smaller that width E1 of hinge element 110, a through-hole 127, and a tapered portion 129. Enlarged end 123 includes an upper surface 124. End 123 includes ground-engaging foot 121, which has a groove 301 that is generally similar to groove 201*a* and 201*b*, and which can accept a rubber component 303, which is generally similar to rubber component 203*a*, 203*b*. Dimensions H2 and G2 are sized so that arm 125 fits into slot 117.

Figure 4A:
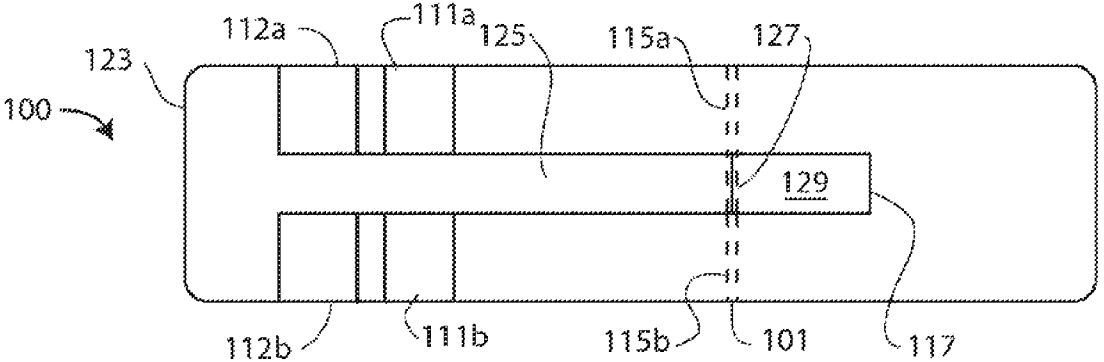
FIG. 4A is a top plan view of the inventive foldable doorstop of FIGS. 1A-1B in a folded (collapsed) configuration.
Figure 4B:
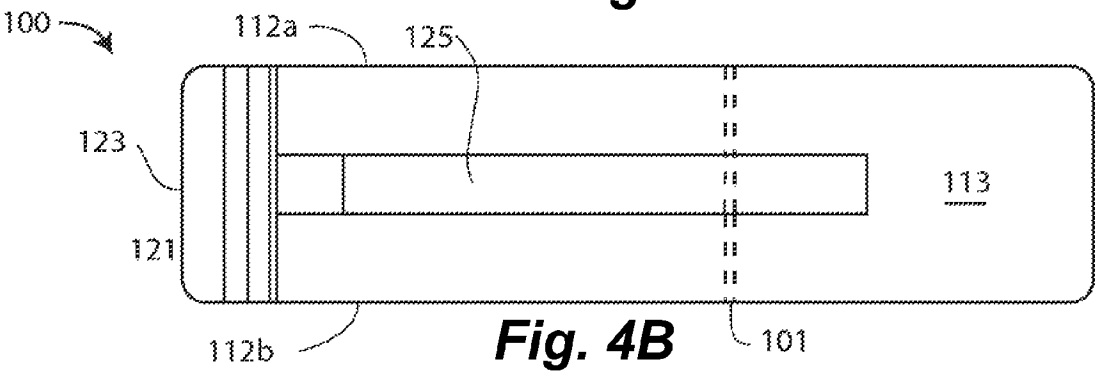
FIG. 4B is a bottom plan view thereof.
Figure 4C:
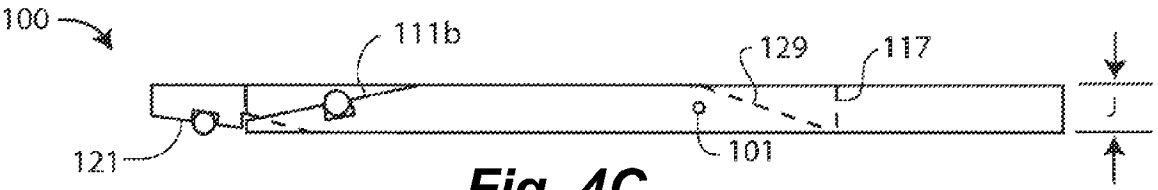
FIG. 4C is a side view in elevation thereof.

FIGS. 4A-4C are views of a foldable door stop 100, wherein FIG. 4A is a top plan view, FIG. 4B is a bottom plan view, and FIG. 4C is a side view in elevation. Hinge elements 110 and 120 are pivotally coupled with a hinge pin 101 that inserts through holes 115*a*, 115*b*, and 127. The folded (or collapsed) doorstop has height J, which is significantly less (thus lower) than the height B of the unfolded (elevated) doorstop.

Figure 5A:
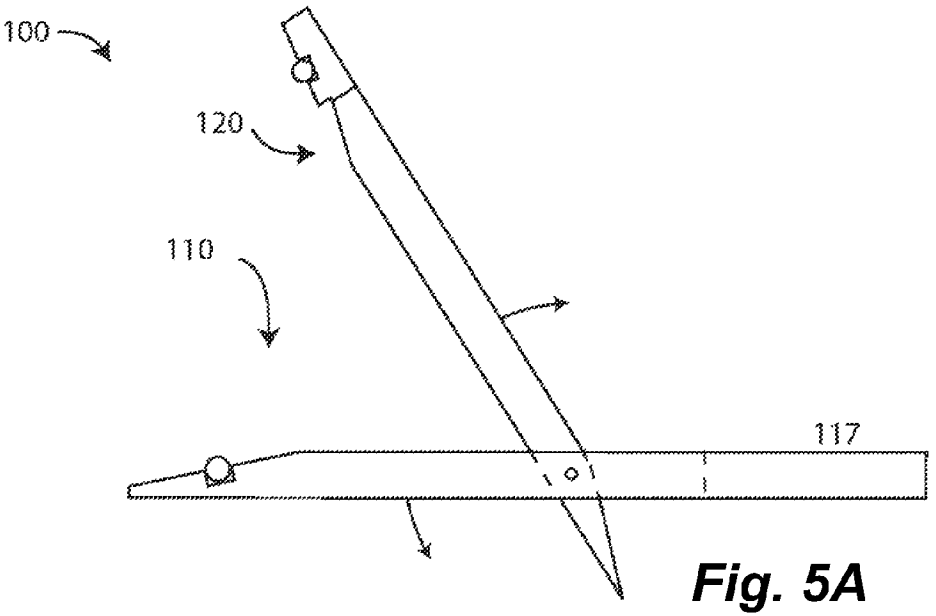
FIG. 5A is a side view in elevation of the inventive door stop in the process of being unfolded from the collapsed configuration of FIG. 4C.
Figure 5B:
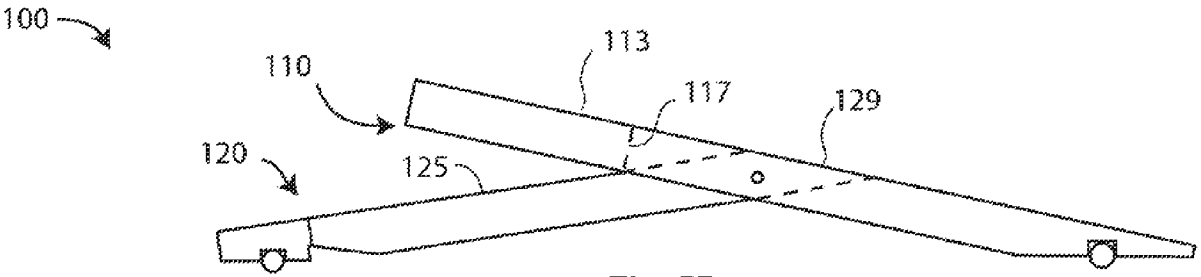
FIG. 5B is a side view in elevation of the doorstop in the fully unfolded (elevated) configuration and oriented for use in stopping a door.

FIGS. 5A and 5B are side views showing the sequential unfolding of the door stop as in FIGS. 3A-3C to the configuration of FIGS. 1A and 1B. As hinge elements 110 and 120 are rotated about hinge pin 101, arm 125 rests against the end of slot 117, and when in the collapsed configuration upper surface 129 of arm 125 and upper surface 124 of enlarged end 123 are each generally coplanar (flush) or slightly recessed from first hinge element upper surface 113.

Referring next to FIGS. 6 through 11, wherein like reference numerals refer to like components in the various views, there is illustrated therein a second preferred embodiment of the foldable doorstop of the present invention, generally denominated 200 herein, which shares all of the features of the first preferred embodiment, except that rubber components and the groove for the same are eliminated and replaced by resilient non-skid planar material comprising or disposed on the ground-engaging portions of the doorstop.

These views collectively show that in a second preferred embodiment 200 a fork hinge element 202 includes a base portion 204 and two parallel arms 206, 208, the arms separated by a space forming a slot 210 for a T-shaped hinge element 212 to be pivotally secured. The T-shaped hinge element 212 includes an enlarged portion 214 and a stem 216, the latter pivotally affixed using a hinge pin 218 inserted through a through hole 219 proximate its end 220 for snap-fit placement in channels 221, 223 disposed in each of the upper interior sides 222, 224 of arms 206, 208 near the root 226 of the arms.

Figure 6:
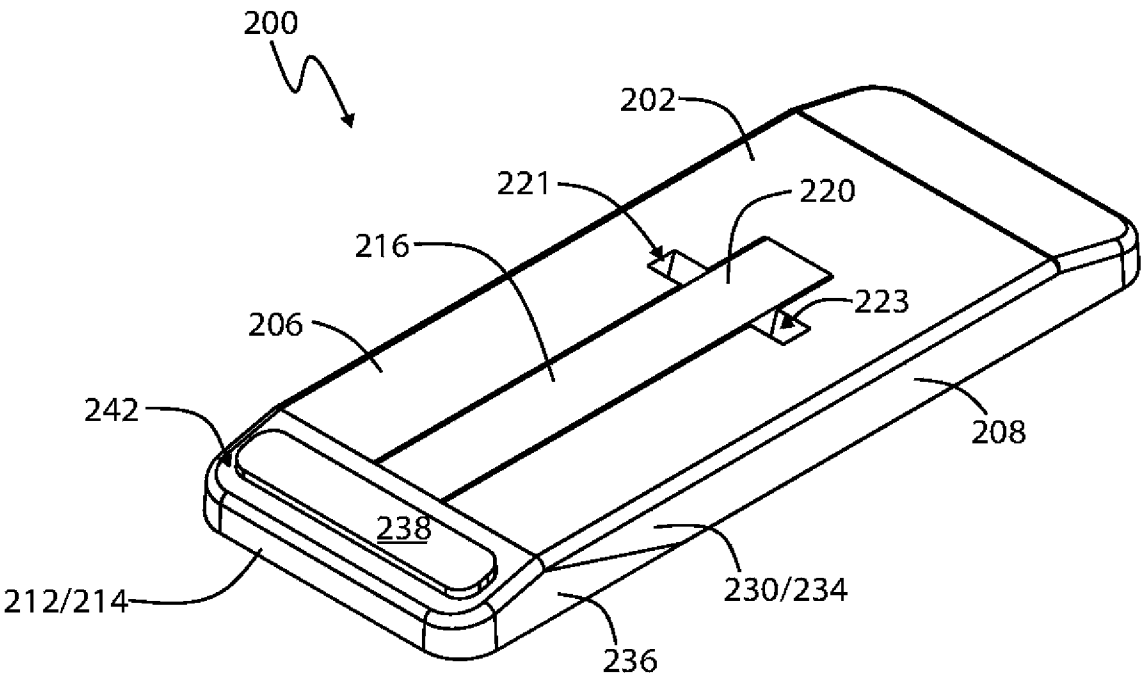
FIG. 6 is an upper end perspective view of a second preferred embodiment of the inventive doorstop showing the doorstop in the fully collapsed configuration for storage and transport.
Figure 7:
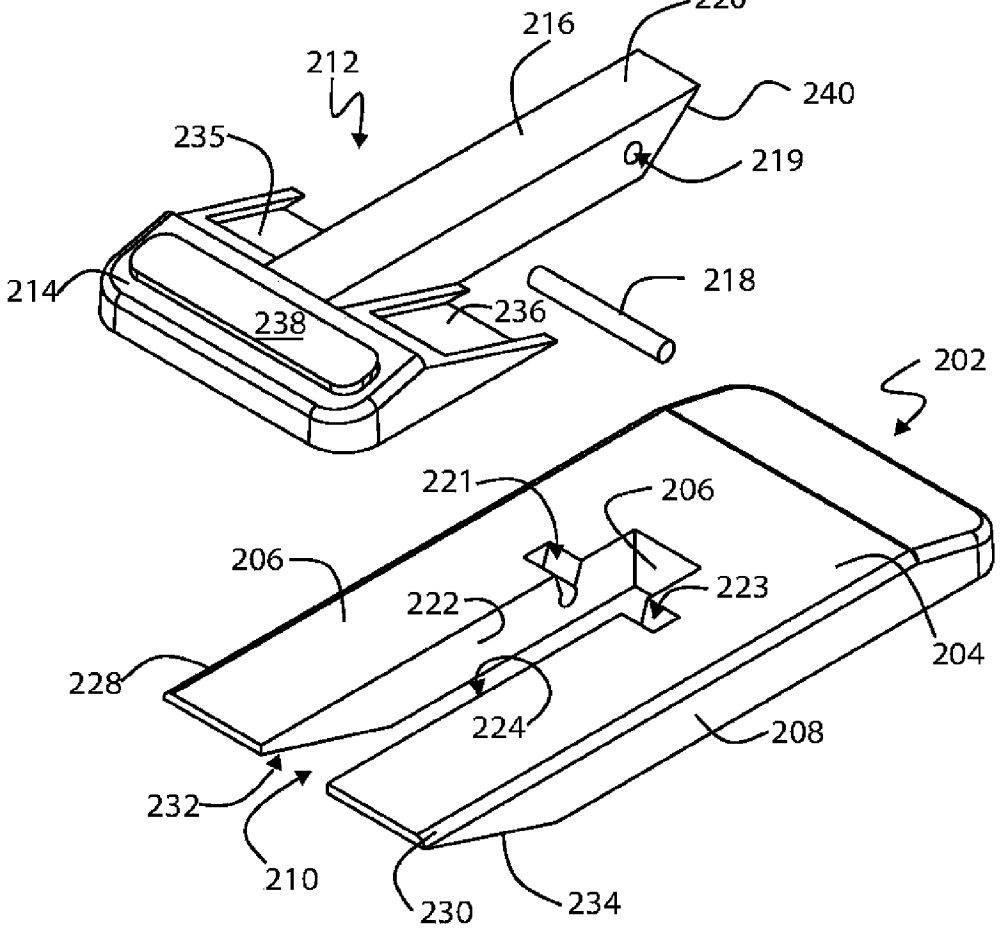
FIG. 7 is an upper exploded perspective view thereof.
Figure 8:
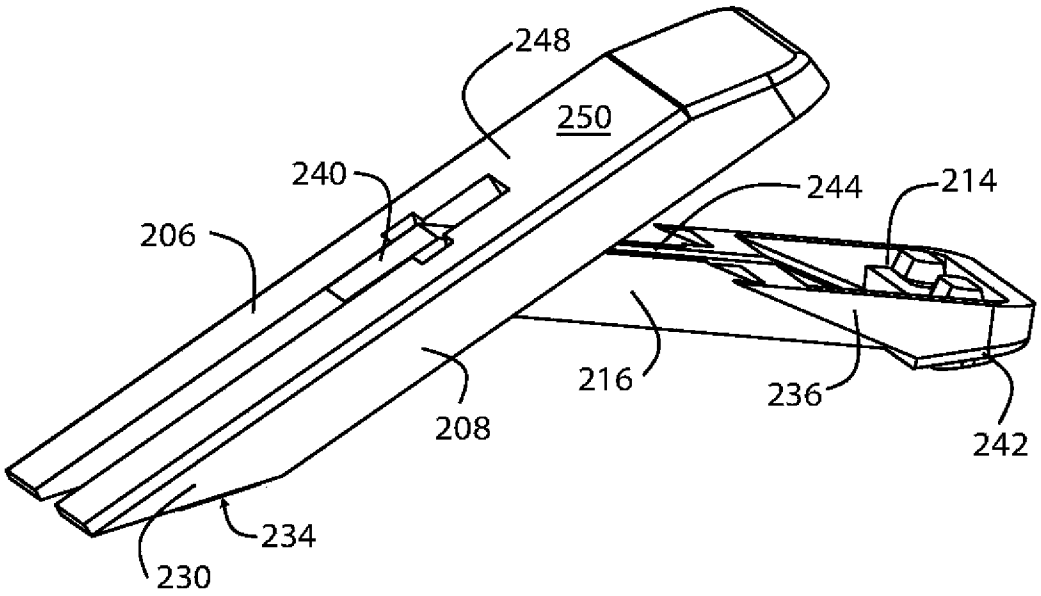
FIG. 8 is an upper side perspective view showing the doorstop in a fully elevated configuration for stopping door.
Figure 9:
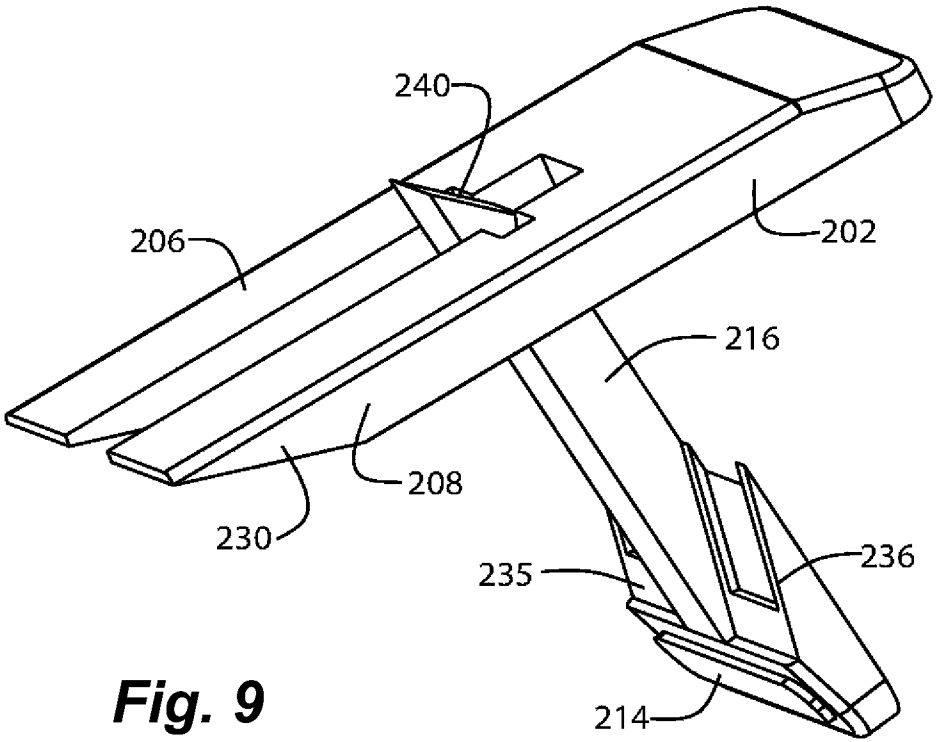
FIG. 9 is an upper side perspective view showing the pivoting elements of the doorstop being pivoted from the elevated configuration of FIG. 8 toward a folded configuration.
Figure 10:
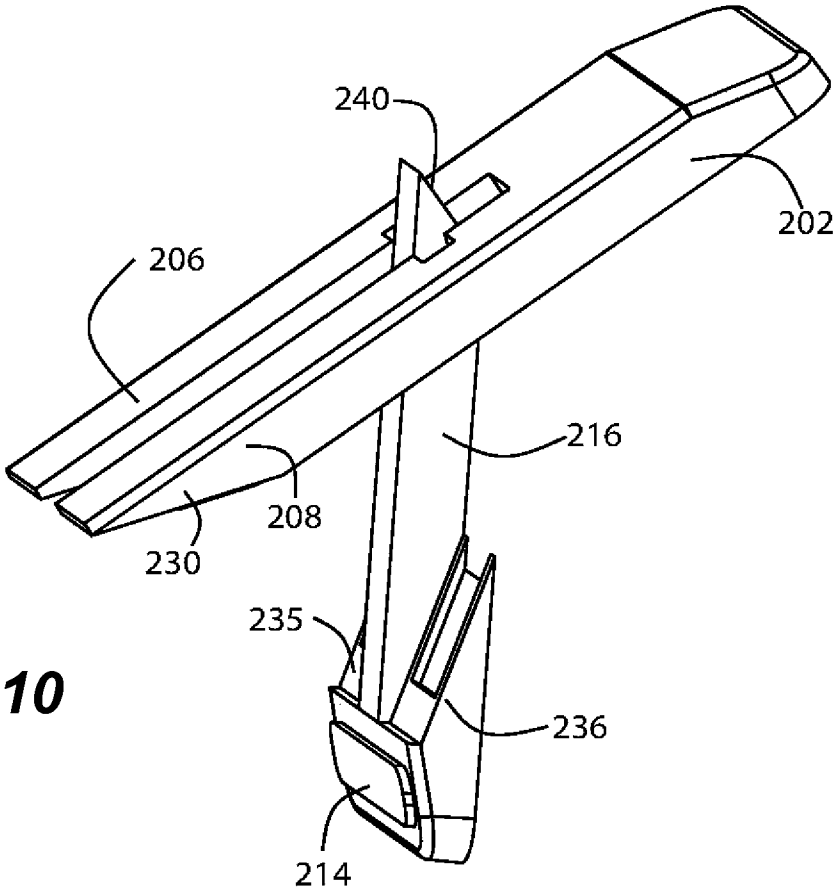
FIG. 10 is the same view showing the doorstop still more completely folded than in the view of FIG. 9.
Figure 11:
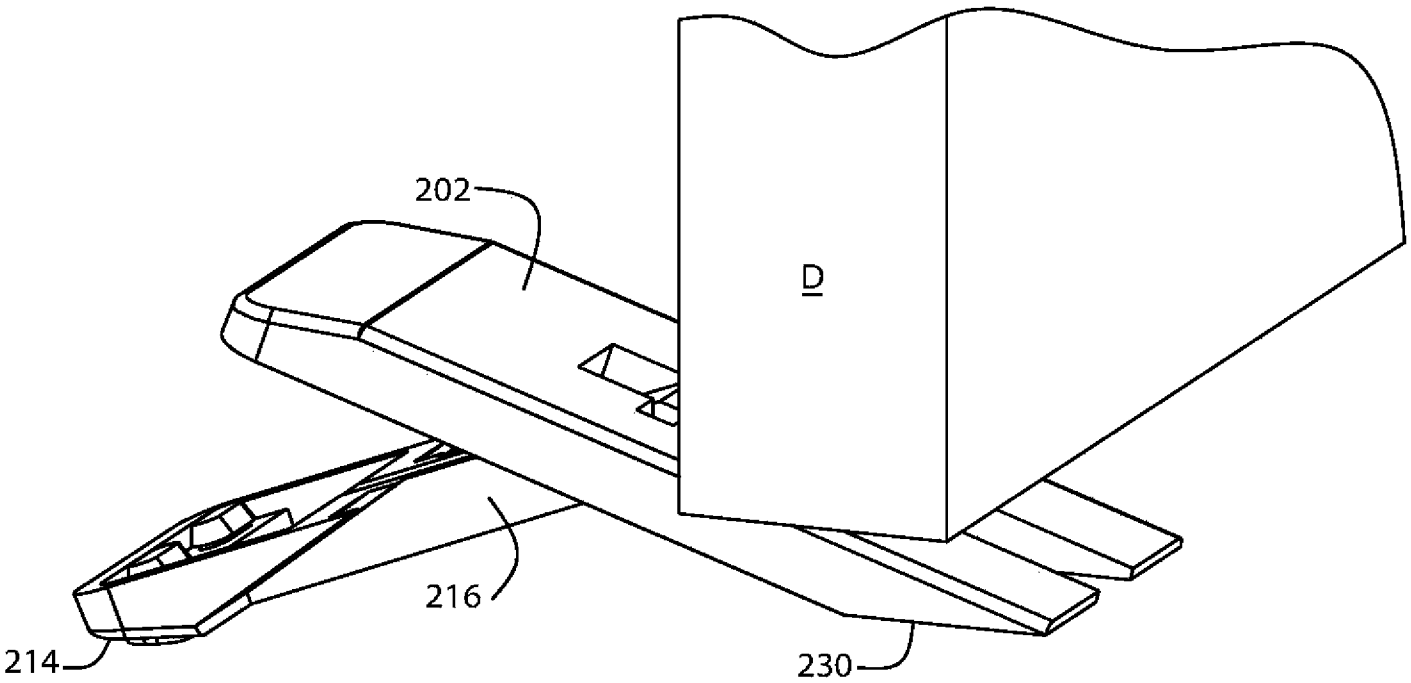
FIG. 11 is an upper front perspective view showing the second preferred embodiment functioning to stop a door.

The end portions 228, 230 of arms 206, 208 each include a bevel 232, 234 that rests on a complementary beveled portions 235, 236 of enlarged portion 214 of T-shaped hinge element 212 when the doorstop is in the folded configuration. The angles are complementary so as to form a closed joint with the angled surfaces approximated when in the collapsed and flat configuration (FIG. 6). When in the deployed, fully elevated configuration for use as a doorstop (see FIG. 8), bevels 232, 234 engage the ground. When in this configuration, the upper surface 238 of enlarged portion 214 of T-shaped hinge element 212 also engages the ground. The end 240 of stem 216 is also beveled, so as to provide a flush upper surface 250 for the doorstop when in the fully elevated configuration (see FIG. 8). Thus the angles for all of the bevels are selected according to the degree of rotation of the fork and pin hinge elements in relation to one another and therefore the angle at which each element will be in relation to the floor. To ensure proper operation on smooth surfaces, it is preferable that the upper surface 238 of enlarged portion 214 be fabricated from a non-skid material or be provided with a slightly resilient non-skid pad 242.

It will be appreciated that the fully elevated position is achieved simply by separating arms 206, 208 from enlarged portion 214 and radially translating the hinging elements more than 90 degrees relative to one another until the bottom 244 of stem 216 encounters the bottom 246 of fork hinge element 202. In that configuration, the top side 248 of fork hinge element 202 is presented at a height sufficient to engage the underside of the bottom rail of a door.

Reference throughout this specification to "a preferred embodiment" or "one embodiment" or "an embodiment" means that a particular feature, structure or characteristic described in connection with the embodiment is included in at least one embodiment of the present invention. Thus, appearances of the phrases "in one embodiment" or "in a preferred embodiment" in various places throughout this specification do not necessarily all refer to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For instance, one with skill would appreciate that the first and second hinge elements could be operationally reversed, such that the T-shaped hinge element is elevated to engage a door while the fork hinge element angles downwardly for non-skid engagement with the floor. Such a configuration is contemplated by and considered to form part of this disclosure and is entirely within the spirit and scope of the invention.

Therefore, the above description and illustrations should not be construed as limiting the scope of the invention, which is defined by the appended claims.

What is claimed as invention is:

1. A hinged wedge doorstop having an elevated configuration and a collapsed configuration, comprising:

a first hinge element having two parallel spaced-apart arms, each of said arms having a ground-engaging end portion;

a second hinge element having an enlarged end portion with a ground-engaging side and a single arm pivotally affixed to said spaced-apart first and second arms with a hinge pin in such a manner so as to permit said first and second hinge elements to pivot in relation to one another about said hinge pin through at least 90 degrees, when in the elevated configuration, said first hinge element is angled upwardly for engaging an underside of a door;

wherein said first hinge element includes a base portion to which said parallel spaced-apart arms are integrally affixed, and further wherein said parallel spaced-apart arms include beveled end portions that rest on first and second beveled portions of said enlarged end portion of said second hinge element when said doorstop is in the folded configuration.

2. The doorstop of claim 1, wherein said first hinge element includes a top side and a bottom side, and said second hinge element includes a top side and a bottom side, and wherein when said doorstop is in the collapsed configuration, said top sides of said first and said second hinge elements are generally coplanar.

3. The doorstop of claim 2, wherein when moving said doorstop into the elevated configuration, rotation of said first hinge element in relation to said second hinge element beyond a predetermined range is prevented by said bottom sides of said first hinge element and said second hinge element coming into engagement.

4. The doorstop of claim 1, wherein said beveled end portions of said parallel spaced-apart arms and said beveled portions of said enlarged end portion are complementary so as to form a closed joint with the angled surfaces approximated when in the collapsed.

5. The doorstop of claim 1, wherein when in the elevated configuration for use as a doorstop said beveled end portions of said parallel spaced-part arms engage the ground and an upper surface of said enlarged end portion of said second hinge element also engages the ground.

6. The door stop of claim 1, wherein each of said ground-engaging end portions of the first hinge element includes a space in which a non-skid material is disposed for non-skid engagement with a floor, and to provide a measure of resilience when the doorstop is urged downwardly by the underside the door.

7. The doorstop of claim 1, wherein said enlarged end ground-engaging side of the second hinge element includes a space in which non-skid material is disposed for non-skid engagement with a floor.

8. The doorstop of claim 1, wherein when in the collapsed configuration said doorstop has height less than the height of the doorstop in the elevated configuration.

* * * * *